United States Patent [19]

Buscher

[11] Patent Number: 4,553,328

[45] Date of Patent: Nov. 19, 1985

[54] GUIDED LIFTING APPARATUS

[75] Inventor: John H. Buscher, East Amherst, N.Y.

[73] Assignee: Eastman Machine Company, Buffalo, N.Y.

[21] Appl. No.: 533,634

[22] Filed: Sep. 19, 1983

[51] Int. Cl.[4] ..... A41H 3/00

[52] U.S. Cl. ..... 33/32 G; 33/32 R; 269/224

[58] Field of Search ..... 33/32 R, 32 G, 32 C; 269/224

[56] References Cited

U.S. PATENT DOCUMENTS 1,183,674 5/1916 Rock ..... 33/32 G X

FOREIGN PATENT DOCUMENTS 1560060 7/1969 Fed. Rep. of Germany ..... 33/32 C

*Primary Examiner*—William D. Martin, Jr.

*Attorney, Agent, or Firm*—Christel, Bean & Linihan

[57] ABSTRACT

Apparatus for lifting a cutter track guide or cloth alignment bar extending across the top surface of a cloth cutting table. On each side of the surface there is a section including a supporting frame in fixed relation to the surface, a lifting member near the frame and movable longitudinally, pivotally and substantially perpendicular to the surface, a guiding arrangement carried by the frame and in guiding contact with the lifting member, and a weight balancing arrangement carried by the frame and connected to the lifting member for applying thereto a force substantially equal and opposite to the weight associated with the track or bar acting on the lifting member. A force transmitting and equalizing arrangement includes a belt and pulley combination connected to the frame of each section and associated with each of the lifting members and with the track or bar. When a lifting force is applied to one of the lifting members, both act in unison to lift the track or bar in a direction away from the supporting surface and to return it while maintaining it parallel to the supporting surface. The pivotal movement of the lifting members allows adjustment of the angle of the track or bar extending across the surface.

9 Claims, 10 Drawing Figures

GUIDED LIFTING APPARATUS

BACKGROUND OF THE INVENTION

This invention relates to the art of lifting apparatus, and more particularly to a new and improved apparatus for lifting an elongated element in a guided and equalized manner relative to a planar supporting surface.

One area of use of the present invention is in cutting sheet material such as cloth, although the principles of the invention can be variously applied. In cutting special orders and short lays of cloth, the sheet material is drawn from a supply such as a roll along a cutting table, the desired length is cut, the next section is drawn along the table and cut, and this procedure is repeated until the required number of pieces of material have been cut to the same measurement and stacked up. The cutting machine is guided in a direction across the table by a track member which is in the form of an elongated bar having a guide slot therealong, and during such procedures a cloth alignment bar also can be used to measure the length and width of the cloth to the exact cutting specifications and to secure the cloth at the far end of the stack. As each piece is cut, in order to accomodate stacking of the pieces, it is necessary to lift the track member and also to lift the cloth alignment bar when it is used and then to return them into contact with the corresponding edge of the stack.

Accordingly, it would be highly desirable to provide a lifting mechanism for cloth cutting tracks and cloth alignment bars which is easy to use and effectively lifts and returns the structures in a guided and equalized manner.

SUMMARY OF THE INVENTION

It is, therefore, a primary object of this invention to provide a new and improved guided lifting apparatus.

It is a more particular object of this invention to provide such apparatus for lifting an elongated element in a guided and equalized manner relative to a planar supporting surface and returning it in the same manner.

It is a further object of this invention to provide such apparatus which lifts an elongated element in an equalized manner in response to a lifting force applied near one end of the element and returns it in the same manner.

It is a further object of this invention to provide such apparatus which is easy to operate manually.

It is a further object of this invention to provide such apparatus which is conveniently adjustable to various angles of an elongated element extending across the supporting surface and lifted by the apparatus.

It is a further object of this invention to provide such apparatus which is readily adaptable to various types of elongated elements for use with planar supporting surfaces.

It is a further object of this invention to provide such apparatus which is simple in construction, effective in operation, and convenient to maintain.

The present invention provides apparatus for lifting an elongated element extending across a substantially planar supporting surface of a structure between opposite sides thereof, the apparatus supporting the elongated element in an initial position disposed substantially parallel to the supporting surface and operable to lift the elongated element in a direction away from the surface and then return it toward the surface when desired. The lifting apparatus includes two sections located on corresponding opposite sides of the supporting surface, each section comprising frame means in fixed relation to the supporting surface, a lifting member located near the frame means and movable longitudinally in a direction substantial ly perpendicular to the supporting surface, guiding means carried by the frame means and in operative guiding contact with the lifting member, and weight balancing means carried by the frame means and operatively connected to the lifting member for applying thereto a force substantially equal and opposite to the weight associated with the elongated element acting on the lifting member. The lifting member and guiding means have co-operating structures which guide the lifting member in longitudinal reciprocal movement along the longitudinal axis thereof and also pivotal movement about that axis.

The lifting apparatus also includes force transmitting and equalizing means in the form of a belt and pulley arrangement connected to the frame means of each section and operatively associated with each of the lifting elements and with the elongated element. In response to application of lifting force to one of the lifting elements, both of the lifting elements act in unison to lift the elongated element in a direction away from the supporting surface and to return the element both in a manner maintaining the elongated element in a plane substantially parallel to the plane of the supporting surface. The pivotal movement of the lifting elements allows adjustment of the angle of the elongated element extending across the surface. The supporting surface can be the top surface of a cloth cutting table, and the elongated element can be the cutter track guide or the cloth alignment bar.

The foregoing and additional advantages and characterizing features of the present invention will become clearly apparent upon a reading of the ensuing detailed description wherein:

BRIEF DESCRIPTION OF THE DRAWING FIGURES

DETAILED DESCRIPTION OF THE ILLUSTRATED EMBODIMENT

Figure 1:
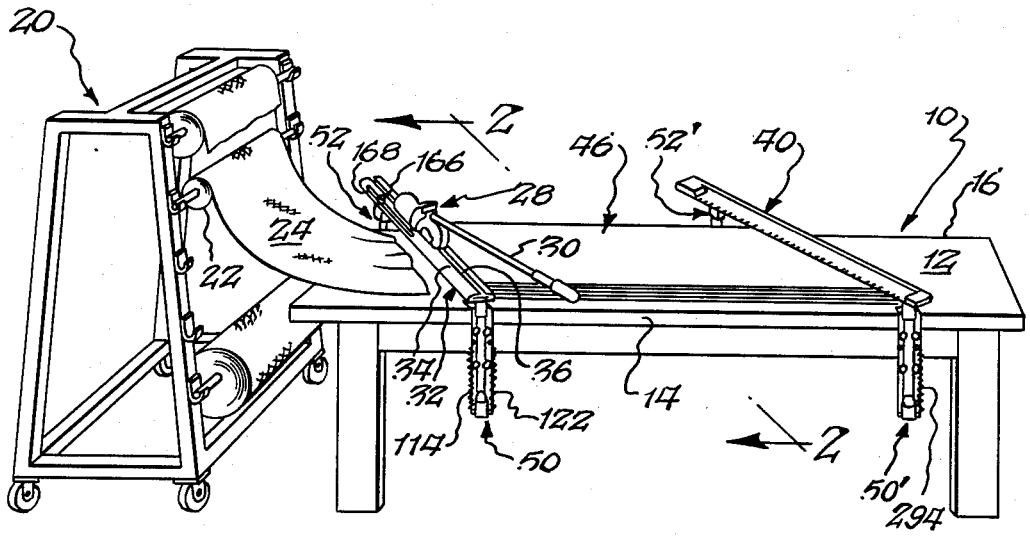
FIG. 1 is a perspective view showing the lifting apparatus of the present invention used for lifting and lowering a cutting track element and an alignment bar in cutting cloth or similar sheet material.

FIG. 1 shows the lifting apparatus of the present invention as it would appear in use with a cutting table, feed roll supply and arrangement for cutting cloth or similar sheet material in special orders or short lays of material. A conventional cutting room table is generally designated 10 and has a planar supporting surface 12, usually disposed substantially in a horizontal plane and having a pair of substantially parallel opposite sides 14 and 16 extending along the length thereof. The cloth or similar sheet material is supplied and fed from various suitable arrangements, and by way of illustration in the apparatus shown, a conventional rack 20 rotatably supports a plurality of supply rolls, one of which is designated 22 and shown in FIG. 1. with a portion 24 of the cloth or sheet material being fed onto surface 12. For cutting the cloth material 24, there is shown a round knife machine generally designated 28 having an extended handle 30 together with a track 32 for guiding the knife in a direction across the surface 12 through the cloth. The track has an operative surface 34 over which the cloth lies and a slot 36 extending therealong for guiding travel of the blade of knife 28. By way of example, the cutter 28 with or without the track 32 is commercially available from Eastman Machine Company under the designation Falcon End Cutter.

In use, track 32 is positioned at the desired location on surface 12 and at the desired angle relative to the longitudinal axis of surface 12. The specified length for each piece of cloth or sheet material to be cut and stacked up is measured from slot 36 toward the opposite end of surface 14 and marked, such as by a cloth alignment bar designated 40 or by other suitable means. The cutter 28 is moved by the operator using handle 30 along track 32 to the rear or starting position which is adjacent the far edge 16 of surface 12 as viewed in FIG. 1. Then the cloth or sheet material 24 is drawn from the roll 22 or otherwise fed onto the surface 12 over the surface 34 of track and further along surface 12 to the edge of the cloth alignment bar 40 or other means for marking and maintaining the position of the cloth at the far end. The operator then pulls cutter 28 by handle 30 along and across slot 36 of track 32 to cut the material into one piece, and then cutter 28 is returned to the rear position. At this point, it is desired to lift the track 32 so that the adjacent edge of the cut piece material falls under the track 32 for stacking and then return track 32 into contact with the edge of the stack. Similarly, when cloth alignment bar 40 is used, it likewise is desired to lift the bar so that the adjacent edge is thereunder during stacking and then return bar 40 into contact with the edge of the stack. Then the arrangement is ready for cutting the next piece to be accumulated in the stack. In FIG. 1 a stack 46 of cut pieces is shown with the opposite end edges under track 32 and alignment bar 40, and the sheet is drawn along over the top of the stack 46 as each successive cut is made.

The track 32 is operatively connected to lifting apparatus according to the present invention which includes first and second portions or sections generally designated 50 and 52, respectively, located adjacent the opposite sides 14 and 16 of surface 12 and operatively connected to corresponding opposite ends of track 32. The cloth alignment bar 40 shown in the arrangement of FIG. 1 also is operatively connected to lifting apparatus according to the present invention and having first and second portions or sections designated 50' and 52', respectively, also adjacent the opposite sides 14,16 and operatively connected to the corresponding opposite ends of bar 40.

Figure 2:
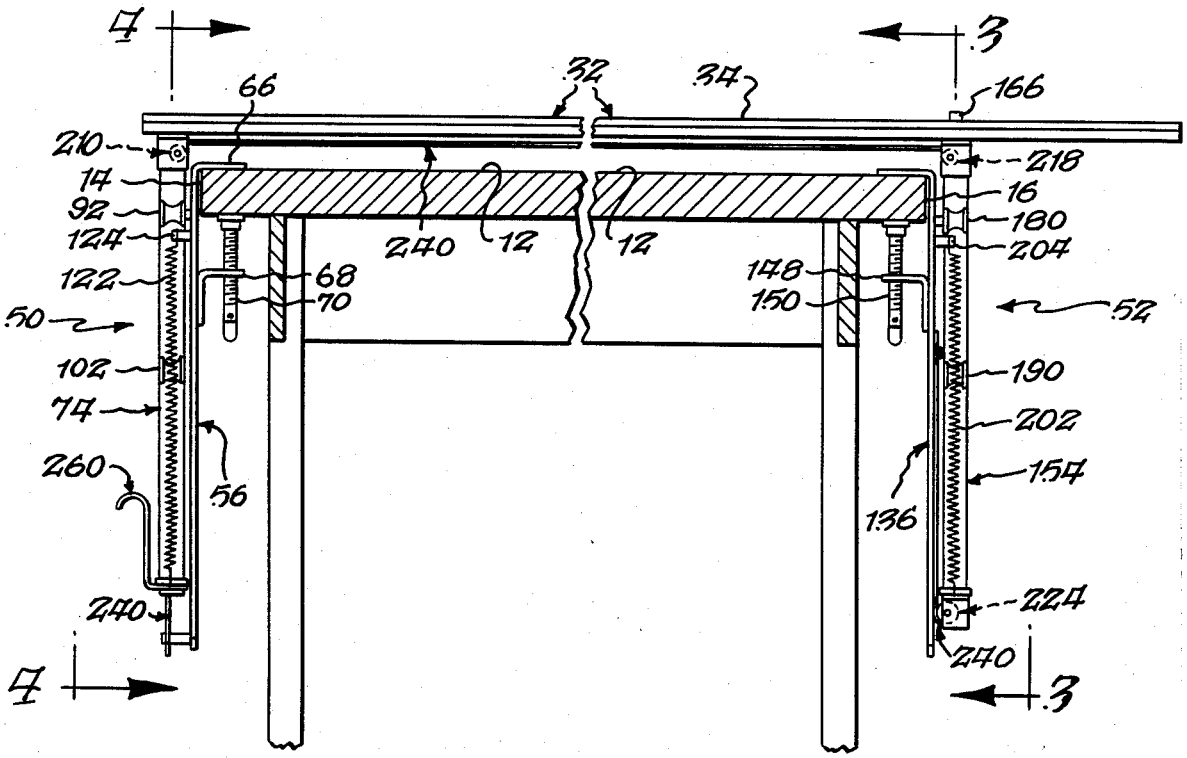
FIG. 2 is an end elevational view, partly in section and with parts removed, taken about on line 2—2 in FIG. 1 showing the lifting apparatus of the present invention with a cloth cutting track element.
Figures 3, 4, 5:
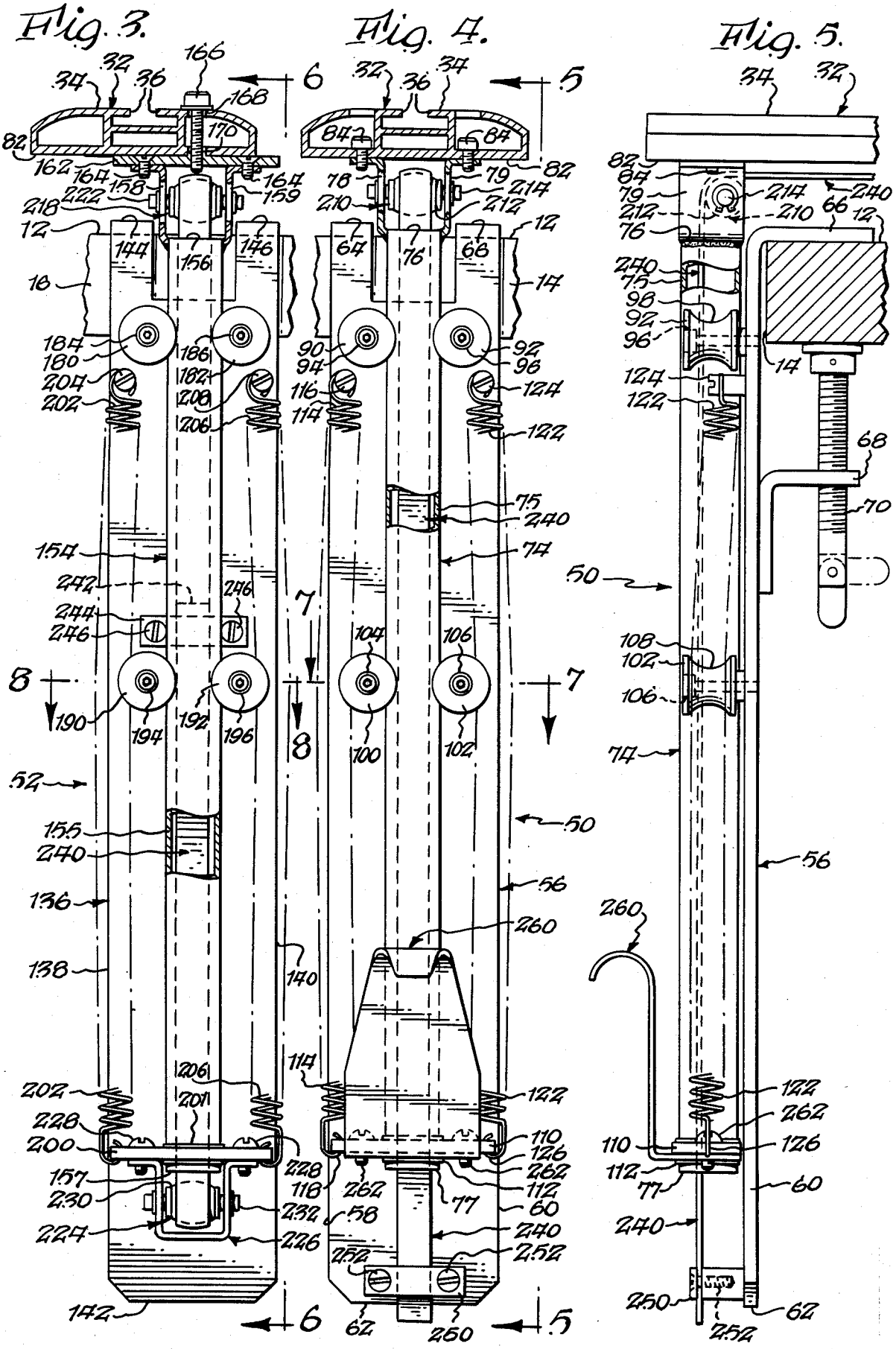
FIG. 3 is a fragmentary side elevational view, partly in section, taken about on line 3—3 in FIG. 2.
FIG. 4 is a fragmentary side elevational view, partly in section, taken about on line 4—4 in FIG. 2.
FIG. 5 is a fragmentary elevational view, partly in section, taken about on line 5—5 in FIG. 4.

Sections 50 and 52 of the apparatus are substantially similar, and referring first to FIGS. 2 and 4, section 50 of the lifting apparatus is shown in detail and comprises supporting frame means in the form of an elongated rectangular metal plate 56 on the side 14 of surface 12 and disposed with the longitudinal axis of the plate 56 substantially perpendicular to surface 12. Plate 56 has a pair of substantially parallel side edges 58,60 and lower end edge 62 as viewed in FIGS. 2 and 4. Plate 56 is adapted for attachment to the supporting structure or table 10 near surface 12 and is provided at the upper end as viewed in FIG. 2 with a clamp structure for fastening to table 10 along the side edge 14. In particular, the plate 56 is formed at the upper end as viewed in FIG. 2 with a pair of integral flange members 64,66 extending perpendicular to plate 56. Spaced from flanges 64,66 are a pair of angle members one designated 68, welded to plate 56. At least one angle member is provided with a screw, for example, the one designated 70 in FIG. 2, thereby providing an adjustable clamp for fastening the plate 56 to the supporting structure in the manner shown. When plate 56 is so attached, it depends from surface 12 as shown in the drawings.

The section 50 of the lifting apparatus also includes an elongated lifting member 74 located in closely spaced relation to the plate or frame 56. The longitudinal axis of member 74 is disposed substantially parallel to the longitudinal axis of the plate 56, and the longitudinal axis of member 74 also is disposed substantially perpendicular to the plane of surface 12, i.e. parallel to the desired direction in which track 32 is to be lifted and returned relative to surface 12. In the apparatus shown, the lifting member 74 has a length substantially equal to the length of frame 56. The lifting member 74 also is supported and guided in the apparatus so as to be movable with respect to frame 56 in a manner which will be described. In the apparatus shown, the lifting member 74 preferably is in the form of a hollow metal tube having a wall 75 and opposite ends 76 and 77.

Lifting member 74 is connected at one end to the elongated element or cutting track 32. In particular, the upper end 76 of tube 74 as viewed in FIGS. 2 and 4 is provided with a bracket comprising a pair of right angle members 78 and 79 welded to opposite sides of tube 74. One leg of each member 78,79 extends longitudinally from the end of tube 74, and the other leg extends outwardly at substantially a right angle. The other legs are connected to the base 82 or bottom wall of track 32 by means of fasteners 84 shown in FIG. 4.

The section 50 of the lifting apparatus also includes guiding means operatively connected to the supporting means or frame 56 and in operative guiding contact with the lifting member 74 for guiding the lifting member during longitudinal, reciprocal movement of member 74. The lifting member 74 and guiding means have cooperating structures whereby member 74 also is guided for pivotal movement about the longitudinal axis of member 74, i.e. about an axis which is substantially perpendicular to surface 12.

In particular, the guiding means in the apparatus shown comprises a first pair of rollers 90 and 92 rotatably connected to frame 56 by pins 94 and 96, respectively, which are fixed to frame 56. The axes of rotation of rollers 92,94 are disposed parallel to each other and perpendicular to the direction of the longitudinal, reciprocal movement of lifting member 74. The rollers 90,92 are located near the upper end of frame 56 as viewed in FIGS. 2 and 4, and are substantially in alignment facing diametrically opposite surface portions of tube 74. The rollers 90,92 can be of metal and have concave surfaces, for example the surface designated 98 in FIG. 5 of roller 92, which surfaces substantially conform to the curvature of the outer surface of tube 74 as will be described.

There is provided a second pair of rollers 100 and 102 rotatably connected by pins 104,106 to frame 56 with the axes of rotation of rollers 100,102 likewise parallel to each other and perpendicular to the direction of longitudinal reciprocal movement of lifting member 74. Rollers 100,102 are located approximately midway along the frame 56 between the ends thereof as shown in FIGS. 2 and 4. As a result, when the lifting member reaches the upper limit of travel, the rollers 100,102 are still in guiding contact with diametrically opposted portions of the outer surface of tube 74. The rollers 100,102 likewise have concave surfaces, for example surface 108 of roller 102 for the same purpose as with rollers 90,92 which will be described.

The portion 50 of the lifting apparatus further includes weight balancing means operatively connected to lifting member 74 and connected to frame 56 for applying to member 74 a force substantially equal to and in an opposite direction to the weight associated with track 32 and acting on lifting member 74. The weight balancing means in the apparatus shown comprises spring means connected at one end to frame 56 near the upper end thereof, i.e. the end closest to track 32, and connected at the other end to the lifting member 74 near the lower end 77 thereof, i.e. the end of member 74 away from track 32. In particular, an elongated bracket 110 is connected to lifting member 74 near end 77 as viewed in FIGS. 2 and 4. Bracket 110 extends laterally of tube 74. Connection is provided by a bushing-like fitting 112 which allows pivotal movement of tube 74 in the bracket 110 but prevents any relative longitudinal or axial movement between tube 74 and bracket 110. A first coil spring 114 is fixed at one end to frame 56 by a screw 116, and it is connected at the other end to bracket 110 for example by engagement between the hook-like end 118 of spring 114 in an aperture in the bracket 110 spring thus extends substantially parallel to the longitudinal axis of tube 74 and is located a short distance laterally outwardly from tube 74. As shown in FIG. 4, spring 56 contacts the surface portion of roller 100 facing away from tube 74 in guiding contact. A second coil spring 122 is fixed at one end to frame 56 by screw 124 and is connected at the other end to bracket 110 on the other side of tube 74 substantially by engagement of the hook-like end 126 of spring 122 in an aperture on the opposite side of bracket 110. Spring 122 contacts the surface portion of roller 102 facing away from tube 74 in guiding contact. Spring 122 thus extends substantially parallel to the longitudinal axis of tube 74 and is located a short distance laterally outwardly from tube 74 along the side opposite spring 114. The connections of springs 114 and 122 to frame 56 and tube 74 are in substantial lateral alignment.

The portion or section 52 of the lifting apparatus on the opposite side 16 of supporting surface 12 includes a substantially identical arrangement of supporting means, lifting member and weight balancing means as compared to the portion 50. Thus, as shown in FIGS. 2 and 3 portion 52 includes supporting means in the form of a frame or plate 136 substantially identical to plate 56 and having parallel side edges 138,140, a lower end 142 and a clamp arrangement at the upper end including flanges 144 and 146, angle members such as 148 and a screw 150. When fastened in place as shown in FIG. 2 and 3, the frame 136 depends from surface 12 in a manner similar to frame 56.

There is also included an elongated lifting member 154 which, like member 74, is closely spaced but movable relative to frame 136 and disposed with the longitudinal axis thereof parallel to the axis of plate 136 and substantially perpendicular to the plane of surface 12, i.e. disposed in a direction parallel to the desired direction of lifting and lowering track 32. Member 154 also is in the form of a hollow metal tube having a wall 155 and ends 156,157 and being of substantially the same length as tube 74. Tube 154 is connected at the upper end 156 to track 32 by the following arrangement. End 156 is provided with a bracket comprising a pair of right angle members 158 and 159 similar to the bracket on the end of tube 74. The outwardly extending bracket legs are fixed to a plate 162 by fasteners 164. Plate 162, in turn, is adjustably connected to track 32 by an adjustment screw 166 extending through a slot 168 in surface 34 and a corresponding slot 170 in base 82 and which screw threads into plate 162. This arrangement conveniently allows angular adjustment of track 32 in a manner which will be described.

Section 52 also includes guiding means identical to that included in section 50. Thus, there is a first pair of rollers 180 and 182 rotatably connected to frame 136 by pins 184 and 186, respectively, in a manner identical to that of the rollers 90 and 92 of section 50. Rollers 180,182 have concave surfaces for example surface 188 of rollers 182 which substantially conform to the outer surface of tube 154. Similarly, there is a pair of rollers 190 and 192 spaced from the rollers 180,182 and rotatably connected to frame 136 by pins 194 and 196, respectively, in a manner identical to that of rollers 100,102 in portion 50. Rollers 190,192 likewise have concave surfaces, for example surface 198 of roller 192, which substantially conform to the outer surface of tube 154.

The portion 52 also includes weight balancing means identical to that of portion 50 and in the apparatus shown comprises spring means similar to that of portion 50. A bracket 200 substantially identical to bracket 110 is connected to tube 154 by fitting 201 allowing relative pivotal movement but preventing relative longitudinal movement. A spring 202 is connected at one end by screw 204 to frame 136 and at the opposite end to bracket 200 in a manner similar to spring 114 and is in guiding contact with the roller 190. Similarly, a second spring 206 is fixed at one end to frame 56 by screw 208 and connected at the opposite end to bracket 190 in a manner similar to spring 122 of portion 50 and is in guiding contact with roller 192.

Figure 6:
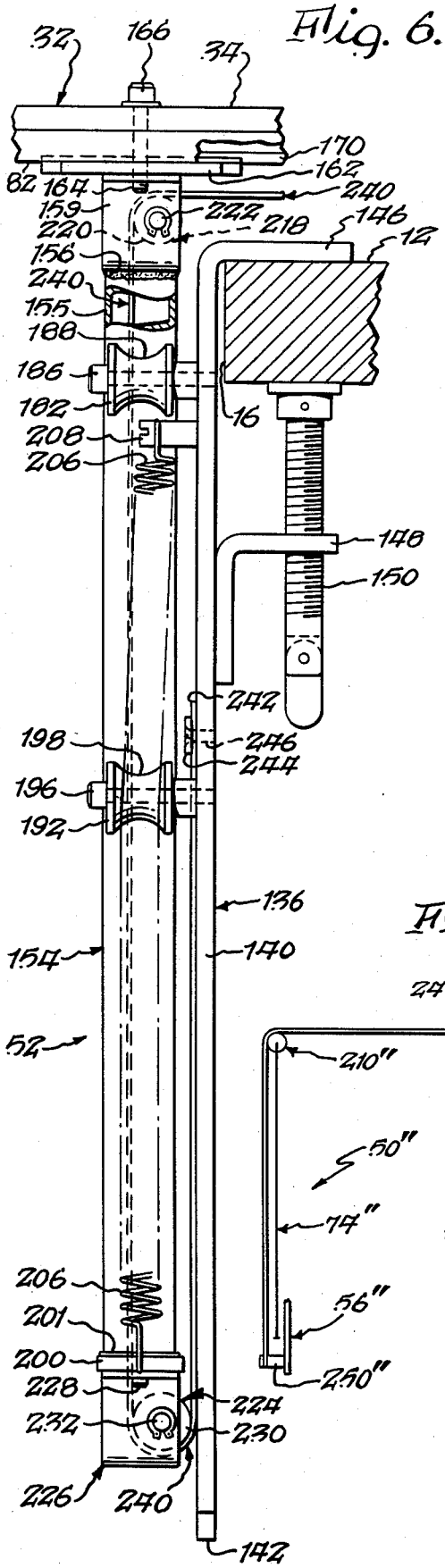
FIG. 6 is a fragmentary elevational view, partly in section, taken about on line 6—6 in FIG. 3.

The apparatus of the present invention comprises force transmitting and equalizing means connected to each of the supporting means or frames 56 and 136 and operatively associated with each of the lifting members 74 and 154 and with the elongated element or track 32 whereby in response to application of lifting force to one of the lifting members, both of the lifting members act in unison to lift the elongated member or track 32 away from supporting surface 12 and in a manner maintaining the track 32 in a plane substantially parallel to the plane of supporting surface 12. Similarly, the apparatus allows lowering or returning track 32 toward surface 12 in response to application of force to one of the members 74,154 in a similar equalized manner. The force transmitting and equalizing means comprises first and second pulleys each on the end of a corresponding one of the first and second lifting members 74 and 154, respectively, and near the elongated element or track 32. As shown in FIGS. 4 and 5, member 74 has a pulley generally designated 210 at the end near track 32 and comprising a roller or wheel 212 rotatable on a pin or shaft 214 which is fixed in the bracket legs 78 and 70. The axis of rotation of wheel 212 is substantially perpendicular to the longitudinal axis of lifting member 74 and hence substantially perpendicular to the direction of movement of member 74. In addition, the axis of rotation of wheel 212 is substantially parallel to the longitudinal axis of surface 12 and hence extends in a direction substantially parallel to surface 12. As shown in FIGS. 3 and 6, a pulley generally designated 218 is on the end of lifting member 154 near track 32. Pulley 218 includes a wheel or roller 220 which is rotatably mounted on a shaft or pin 22 which is fixed to bracket legs 158,159. The axis of rotation of wheel 220 is substantially perpendicular to the longitudinal axis of lifting member 154 and hence substantially perpendicular to the direction of movement of member 154. In addition, the axis of rotation of wheel 220 is substantially parallel to the longitudinal axis of surface 12 and hence extends in a direction substantially parallel to surface 12.

The force transmitting and equalizing means further comprises a third pulley on the opposite end of one of the lifting members. In the apparatus hwon, lifting member 154 as indicated in FIGS. 3 and 6 is provided with a pulley generally designated 224 near the lower end 157. In particular there is provided a generally U-shaped bracket 226 fixed to bracket 190 by fasteners 228. Pulley 224 comprises a wheel or roller 230 rotatably mounted on a shaft or pin 232 which is fixed to opposite legs of bracket 226. The axis of rotation of wheel 230 is substantially perpendicular to the longitudinal axis of lifting member 154 and hence substantially perpendicular to its direction of longitudinal movement. The axis of rotation of pulley 224 is substantially parallel to that of the other pulleys 210 and 218.

The force transmitting and equalizing means further comprises an elongated belt generally designated 240 connected at opposite ends to corresponding ones of the supporting frames, operatively associated with the pulleys on the lifting elements and extending between surface 12 and the elongated element or track 32. As shown in FIGS. 3 and 6, belt 240 has one end 242 fixed by a clamp bar 244 and fasteners 246 to frame 136 substantially midway between the ends thereof. Belt 240 extends downwardly along between frame 136 and lifting member 154 and around pulley 224 and then upwardly through and along tube 154 toward the opposite end thereof and continues around pulley 218 and then across supporting surface 12 beneath the elongated element or track 32. Belt 240 continues around the pulley 210 and downwardly along tube 74 beyond the lower end 77 thereof where it is releasably secured by a clamp bar 250 and screw fasteners 252. The belt 240 continues therebeyond a selected distance for a purpose to be described.

The apparatus further comprises means for applying an external force to one of the lifting members to cause lifting or lowering movement. In the apparatus shown a handle 260 is connected by fasteners 262 to bracket 110 carried by lifting member 74.

Springs 114, 122, 202 and 206 are selected to provide a force on the lifting members 74 and 154 substantially equal and opposite to the weight associated with the elongated element 32 acting on the member 74,154 when the springs are extended as shown in FIGS. 2–6. In the illustrative apparatus shown, this is the weight of track 32 plus the cutter 28 and handle 30 carried thereby. Typically, the combined weight of a track having a length of about six feet and a cutter and handle is about fifteen pounds. Each of the four springs would provide a force equal to about one-fourth that combined weight.

When used in a cloth cutting set-up like FIG. 1, the apparatus is installed in the following manner. The desired location and angle of track 32 on surface 12 is determined. Belt 240 is fixed adjacent end 242 by clamp 244 and is pre-fed through both sections 50 and 52 of the apparatus. Section 52 first is connected to the far side 16 by clamping to the edge as previously described. Belt 240 extends across surface 12 and section 50 then is clamped to the rear side 14 of surface as previously described. Belt 240 then is drawn or pulled tight and secured by tightening clamp 250 on section 50. The belt 240 extends across surface 12 at the desired location and angle for track 32. The track 32 then is installed by fasteners 84 to section 50 and adjusted screw 166 to section 50. The precise desired angle of track 32 relates to the longitudinal axis of surface 12 or to sides 14,16 is obtained with screw 166 loosened so as to be movable along slot 168 and pivoting track 32 about the axis of lifting member 74 to the desired angle and then securing the location of track 32 by tightening screw 166.

The apparatus is in an initial or rest position with track 32 nearest the surface 13 or stack 46 as shown in FIG. 1. As described in connection with FIG. 1, after a piece of cloth is cut, it is desired to lift track 32 so that the adjacent edge of the cut piece falls under track 32 for stacking. The operator simply grasps handle 260 on section 50 and applies a small upward lifting force sufficient to change the balanced condition of force of springs 114, 122, 202 and 206 and the weight associated with track 32. The upward force of the springs then overcomes or exceeds the downward force of the weight. Thus, in response to this application of a small amount of force at the one end of the assembly, the apparatus of the present invention including the arrangement of springs, belt 240, pulleys 210, 218 and 224 and lifting members 74 and 154 operates to lift track uniformly in an equalized manner from surface 12. In other words, track 32 is lifted in a manner maintaining it substantially parallel to the plane of surface 12.

Figure 9:
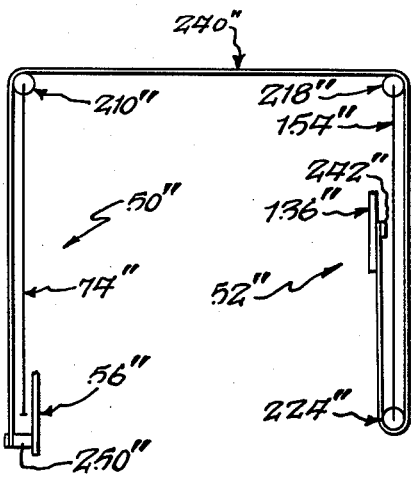
FIGS. 9 and 10 are diagrammatic views illustrating the apparatus at two stages of operation.
Figure 10:
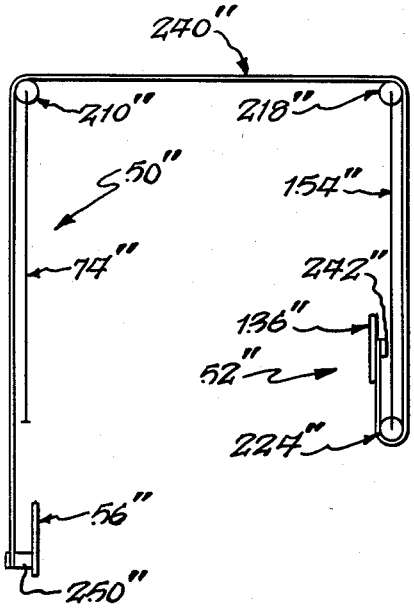

The foregoing is illustrated in further detail by the diagrammatic views of FIGS. 9 and 10 where the components previously described are identified by the same reference numerals with a double prime designation. FIG. 9 is the initial or rest position, and FIG. 10 shows how some of the components change position and others remain fixed during the lifting operation. As the apparatus changes from the initial position of FIG. 9 to the lifted condition of FIG. 10, lifting member 74″,154″ move upwardly in unison. Member 74″ carries pulley 210″ with it, and member 154″ carries pulleys 218″ and 224″ with it. Belt 240″ is of fixed length and the one end fixed by clamp 250″ remains stationary and the other end 242″ remains stationary. As the apparatus changes from the initial condition of FIG. 9 to the lifting condition of FIG. 10, the distance between the end of belt at bracket 250″ and pulley 210″ increases and the distance between the belt end 242″ and pulley 224″ decreases by the same amount. This provides the uniform or equalized nature of the lift. In particular, the effect of the force applied through handle 260'' to member 74'' upsetting the balance between the upward spring force and downward weight is transmitted through the belt and pulley arrangement to member 154''. In other words, the immediate result is upward movement of member 74'' increasing the distance between the end of belt 240'' at clamp 250'' and pulley 210''. The finite length of belt 240'' and the fixed position of both ends causes a simultaneous and corresponding decrease in the distance between belt end 242'' and pulley 224'' causing simultaneous and identical lifting of member 154''. The extent of upward movement of members 74'',154'' is determined by the location of belt end 242''.

When it is desired to return or lower track 32, the operator simply applies a downward force to handle 260 to return the apparatus to a position placing track 32 on surface 12 or on the edge of the top sheet of a stack as shown in FIG. 1. During the downward or return movement, the arrangement of pulleys 210, 218 and 224 and belt 240 together with lifting members 74 and 154 transmit the effect of downward force on member 74 to member 154 also thereby providing a uniform and equalized downward movement of track 32.

Thus, the apparatus of the present invention advantageously permits a single person to lift and return a relatively long element such as track 32 relative to a surface 12 by simply manually applying a relatively small force to the apparatus at only one end of the element. The uniform and equalized lift and return of element 32 is particularly advantageous in proper stacking of cut pieces of sheet material such as cloth.

When it is desired to change the angle of orientation of track 32, adjusted screw 166 is loosened at the clamp on frame 156 of section 52 is loosen. Then this end of track 32 is moved along side 16 by virtue of to reach the desired angle. During this movement of track 32, the lifting members 74 and 154 which are connected to track 32 pivot about their respective longitudinal axes. Also, adjustment screw 166 moves along slot 168 which typically has a length about one-third the overall length of track 32. During this adjustment, clamp 250 is loosened to accommodate movement of belt 240 whereupon it is tightened when the adjustment is completed. When the desired angle of track is achieved, it is maintained by tightening screw 166. Also, further adjustment of both the angle of track 32 and its location along both sides can be made by loosening the clamps on both sections 50 and 52 and moving them along sides 14 and 16 together with pivoting of track 32.

Figure 7:
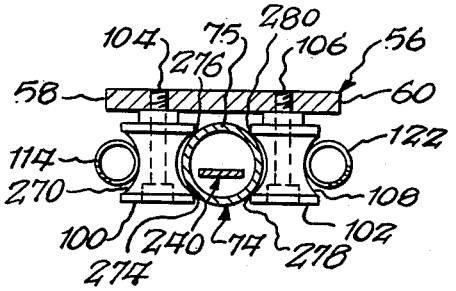
FIG. 7 is a sectional view taken about on line 7—7 in FIG. 4.

The structures of the lifting elements 74,154 and the guide means or rollers co-operate to provide the foregoing pivoted movement. Thus, the concave surfaces of the rollers have a curvature which substantially conform to the outer surface of the tubes 74 and 154 to facilitate the foregoing pivoted movement. This is shown in further detail in FIGS. 7 and 8 where concave surface 108 of roller 102 and concave surface 270 of roller 100 substantially conforms to the outer surface of tube 74. Similarly, in FIG. 8 the concave surface 198 of roller 192 and the concave surface 272 of roller 190 substantially conform to the outer surface of tube 154. The same is true for rollers 90,92 associated with tube 74 and rollers 180, 182 associated with tube 154.

Figure 8:
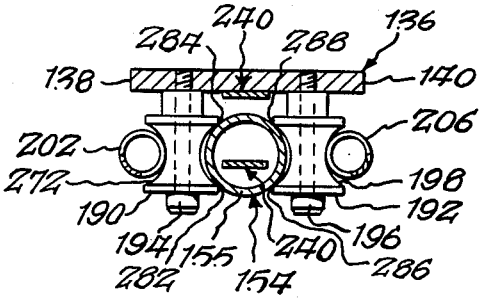
FIG. 8 is a sectional view taken about on line 8—8 in FIG. 3.

The co-operating structures of tubes 74,154 and the rollers also provide a guided longitudinal movement of tubes 74,154 in a manner minimizing friction or resistance. Each of the rollers has at least one, preferably two points or zones of annular line or point contact with the corresponding tube surface. The annular line contact is at the junction of the roller concave surface with a surface portion adjacent the roller annular end face. For example, roller 100 shown in FIG. 7 has two annular surface portions of relatively short axial length adjacent corresponding ones of the roller axial end faces. The concave surface 270 is between these two annular portions. The points of annular line or point contact with the surface of tube 74 are designated 274 and 276 in FIG. 7. Roller 102 has two similar points 278 and 280 of annular line or point contact with the surface of tube 74. Similar points of annular line or point contact with the surface of tube 154 are shown in FIG. 8 at 282 and 284 for roller 190 and at 286 and 288 for roller 192. The same is true for rollers 90 and 92 associated with tube 74 and for rollers 180 and 182 associated with tube 154.

As previously described in connection with FIG. 1 the apparatus of the present invention also can be used to raise and lower a cloth alignment bar 40. Since bar 40 is relatively lighter in weight than track 32 only one spring is needed with each section 50',52' of the apparatus, for example the single spring 294 shown in FIG. 1. A single spring (not shown) also would be provided on section 52''. The operator of the apparatus is the same as that described in lifting track 32.

One alternative to coil springs 114,122, 202 and 206 is a counterweight for each section 50 and 52. Typically one counterweight for each section is sufficient. Since the counterweight acts downwardly, it would be connected through a wire or line trained around a roller or shaft connected to the corresponding frame and then connected to the corresponding lifting element near the lower end thereof. Another alternative is a constant force spring or constant rate spring of the Negater type. Typically one spring for each section 50,52 would be employed and connected between the frame and lifting element in a manner similar to the coil springs. This would provide a uniform counteracting force to the weight of track 32 regardless of the height or distance through which it is lifted.

Belt 240 typically is in the form of a tape of strong synthetic fabric material. It could also be in the form of a line such as a wire or cord, in which case the pulley wheels might be grooved.

It is therefore apparent that the present invention accomplishes its intended objects. While embodiments of the present invention have been described in detail, this is for the purpose of illustration, not limitation.

I claim:

1. Apparatus for lifting an elongated bar extending across a substantially planar supporting surface of a structure and extending between opposite sides of the structure, said apparatus holding the elongated bar in an initial position disposed substantially parallel to the supporting surface and operable to lift the elongated bar in a direction away from the supporting surface, said lifting apparatus comprising:

(a) first and second supporting frame means on said opposite sides of the structure and adapted for connection to the structure in fixed relation to the supporting surface;

(b) first and second elongated lifting members each associated with a corresponding one of said supporting frame means and connected at one end thereof to the elongated bar at a corresponding end of the bar and each lifting member being disposed for longitudinal reciprocal movement in a direction substantially perpendicular to the plane of the supporting surface;

(c) first and second guiding means carried by corresponding ones of said first and second supporting frame means and in operative guiding contact with corresponding ones of said lifting members for guiding said lifting elements during said longitudinal reciprocal movement thereof;

(d) said lifting members and said guiding means having co-operating structures allowing pivotal movement of said lifting members about the longitudinal axes thereof to allow adjustment of the angle at which the bar extends across the supporting surface;

(e) first and second weight balancing means operatively connected to corresponding ones of said first and second lifting members and carried by corresponding ones of said first and second supporting frame means for applying to each of said lifting members a force substantially equal and opposite to the weight associated with the elongated bar acting on said lifting members; and (f) force transmitting and equalizing means operatively connected to each of said supporting frame means and operatively associated with each of said lifting members and with the elongated bar whereby in response to application of lifting force to one of said lifting members, both of said lifting members act in unison to lift the elongated bar in a direction away from the supporting surface and in a manner maintaining the elongated bar in a plane substantially parallel to the plane of the supporting surface.

2. Apparatus according to claim 1, wherein said force transmitting and equalizing means comprises first and second pulleys each on the ends of the corresponding first and second lifting members near the elongated bar, a third pulley on the opposite end of one of said lifting members, a belt fixed at one end to the one of said supporting frame means associated with said one lifting member at a location between the ends of said lifting member in said initial position, said belt extending along said lifting member in one direction around said third pulley and returning along said lifting member toward the opposite end thereof and around the pulley on that end and then accross the supporting surface beneath the elongated bar and then around the pulley on the other lifing member and then longitudinally along that lifting member and beyond the member and connected to said supporting frame means whereby upon application of a lifting force to the other of said lifting members both of said lifting members act in unison to lift the elongated bar in a direction away from said supporting surface and in a manner maintaining the elongated bar in a plane substantially parallel to the plane of the supporting surface.

3. Apparatus according to claim 1, wherein each of said guiding means comprises at least two pairs of guide rollers rotatably connected to said supporting frame means, the rollers of each pair being located on corresponding opposite sides of the lifting member, and the pairs being located in spaced relation along the path of movement of the corresponding lifting member.

4. Apparatus according to claim 3, wherein each of said lifting members is in the form of a tube and wherein said rollers have concave surfaces conforming substantially to the outer surface of the corresponding tube.

5. Apparatus according to claim 4, wherein each of said rollers has at least one zone of annular line contact with the corresponding tube.

6. Apparatus according to claim 1, wherein said first and second weight balancing means each comprises spring means operatively connected to corresponding ones of said first and second lifting members and connected to corresponding ones of said first and second supporting frame means.

7. Apparatus according to claim 1, wherein the supporting surface is for supporting sheet material such as cloth during cutting thereof and the elongated bar is a cutter track for guiding a cloth cutting machine.

8. Apparatus according to claim 1, wherein the supporting surface is for supporting sheet material such as cloth during cutting thereof and the elongated bar is a cloth alignment bar.

9. Apparatus according to claim 1, wherein said force transmitting and equalizing means comprises an arrangement of belt and pulleys operatively connected to said first and second supporting frame means and to said first and second lifting members with said belt extending across the surface beneath the elongated bar, whereby upon application of a lifting force to one of said lifting members both of said lifting members act in unison to lift the elongated bar in a direction away from the supporting surface and in a manner maintaining the elongated bar in a plane substantially parallel to the plane of the supporting surface.

* * * * *